US010267068B2

(12) United States Patent
Van Wiemeersch et al.

(10) Patent No.: US 10,267,068 B2
(45) Date of Patent: Apr. 23, 2019

(54) ELECTRONIC VEHICLE ACCESS CONTROL SYSTEM

(71) Applicant: Ford Global Technologies, LLC, Dearborn, MI (US)

(72) Inventors: John Robert Van Wiemeersch, Novi, MI (US); Robert Bruce Kleve, Ann Arbor, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/867,090

(22) Filed: Jan. 10, 2018

(65) Prior Publication Data

US 2018/0128022 A1 May 10, 2018

Related U.S. Application Data

(63) Continuation of application No. 14/281,998, filed on May 20, 2014, now Pat. No. 9,903,142, which is a (Continued)

(51) Int. Cl.

| | |
|---|---|
| ***E05B 17/10*** | (2006.01) |
| ***E05B 77/02*** | (2014.01) |
| ***E05B 77/54*** | (2014.01) |
| ***E05B 81/06*** | (2014.01) |
| ***E05B 81/14*** | (2014.01) |

(Continued)

(52) U.S. Cl.

CPC ..... *E05B 77/54* (2013.01); *E05B 77/02* (2013.01); *E05B 81/64* (2013.01); *E05B 81/76* (2013.01); *E05B 81/77* (2013.01); *E05B 85/12* (2013.01); *E05B 17/10* (2013.01); *E05B 81/06* (2013.01); *E05B 81/14* (2013.01); *E05B 81/54* (2013.01);

(Continued)

(58) Field of Classification Search

None

See application file for complete search history.

(56) References Cited

U.S. PATENT DOCUMENTS

| | | | |
|---|---|---|---|
| 2,229,909 | A | 1/1941 | Wread |
| 3,479,767 | A | 11/1969 | Gardner et al. |

(Continued)

FOREIGN PATENT DOCUMENTS

| | | | |
|---|---|---|---|
| CN | 1232936 | C | 12/2005 |
| CN | 201198681 | Y | 2/2009 |

(Continued)

OTHER PUBLICATIONS

Kistler Instruments, "Force Sensors Ensure Car Door Latch is Within Specification," Article, Jan. 1, 2005, 3 pages.

(Continued)

*Primary Examiner* — Thomas S McCormack

(74) *Attorney, Agent, or Firm* — Vichit Chea; Price Heneveld LLP

(57) ABSTRACT

A vehicle door includes a powered latch mechanism and an interior door handle having first and second sensors disposed on opposite sides of the interior door handle. The first and second sensors are configured to detect the presence of a user's hand to control operation of the powered latch mechanism. The powered latch may be unlatched if an unlatch switch is actuated and the first and second sensors detect the presence of a user's hand.

14 Claims, 5 Drawing Sheets

Related U.S. Application Data continuation-in-part of application No. 14/280,035, filed on May 16, 2014, which is a continuation-in-part of application No. 14/276,415, filed on May 13, 2014.

(51) Int. Cl.

| | |
|---|---|
| ***E05B 81/54*** | (2014.01) |
| ***E05B 81/64*** | (2014.01) |
| ***E05B 81/76*** | (2014.01) |
| ***E05B 85/10*** | (2014.01) |
| ***E05B 85/12*** | (2014.01) |

(52) U.S. Cl.

CPC ..... *E05B 85/10* (2013.01); *Y10T 292/1082* (2015.04)

(56) References Cited

U.S. PATENT DOCUMENTS 3,751,718 A 8/1973 Hanchett
3,854,310 A 12/1974 Paull
3,858,922 A 1/1975 Yamanaka
4,193,619 A 3/1980 Jeril
4,206,491 A 6/1980 Ligman et al.
4,425,597 A 1/1984 Schramm
4,457,148 A 7/1984 Johansson et al.
4,640,050 A 2/1987 Yamagishi et al.
4,672,348 A 6/1987 Duve
4,674,230 A 6/1987 Takeo et al.
4,674,781 A 6/1987 Reece et al.
4,702,117 A 10/1987 Tsutsumi et al.
4,848,031 A 6/1989 Yamagishi et al.
4,858,971 A 8/1989 Haag
4,889,373 A 12/1989 Ward et al.
4,929,007 A 5/1990 Bartczak et al.
5,018,057 A 5/1991 Biggs et al.
5,056,343 A 10/1991 Kleefeldt et al.
5,058,258 A 10/1991 Harvey
5,074,073 A 12/1991 Zwebner
5,239,779 A 8/1993 Deland et al.
5,263,762 A 11/1993 Long et al.
5,297,010 A 3/1994 Camarota et al.
5,332,273 A 7/1994 Komachi
5,334,969 A 8/1994 Abe et al.
5,494,322 A 2/1996 Menke
5,497,641 A 3/1996 Linde et al.
5,535,608 A 7/1996 Brin
5,547,208 A 8/1996 Chappell et al.
5,581,230 A 12/1996 Barrett
5,583,405 A 12/1996 Sai et al.
5,618,068 A 4/1997 Mitsui et al.
5,632,120 A 5/1997 Shigematsu et al.
5,632,515 A 5/1997 Dowling
5,644,869 A 7/1997 Buchanan, Jr.
5,653,484 A 8/1997 Brackmann et al.
5,662,369 A 9/1997 Tsuge
5,684,470 A 11/1997 Deland et al.
5,744,874 A 4/1998 Yoshida et al.
5,755,059 A 5/1998 Schap
5,783,994 A 7/1998 Koopman, Jr. et al.
5,802,894 A 9/1998 Jahrsetz et al.
5,808,555 A 9/1998 Bartel
5,852,944 A 12/1998 Collard, Jr. et al.
5,859,417 A 1/1999 David
5,896,026 A 4/1999 Higgins
5,896,768 A 4/1999 Cranick et al.
5,901,991 A 5/1999 Hugel et al.
5,921,612 A 7/1999 Mizuki et al.
5,927,794 A 7/1999 Mobius
5,964,487 A 10/1999 Shamblin
5,979,754 A 11/1999 Martin et al.
5,992,194 A 11/1999 Baukholt et al.
6,000,257 A 12/1999 Thomas
6,027,148 A 2/2000 Shoemaker
6,038,895 A 3/2000 Menke et al.
6,042,159 A 3/2000 Spitzley et al.
6,043,735 A 3/2000 Barrett
6,050,117 A 4/2000 Weyerstall
6,056,076 A 5/2000 Bartel et al.
6,065,316 A 5/2000 Sato et al.
6,072,403 A 6/2000 Iwasaki et al.
6,075,294 A 6/2000 Van den Boom et al.
6,089,626 A 7/2000 Shoemaker
6,091,162 A 7/2000 Williams, Jr. et al.
6,099,048 A 8/2000 Salmon et al.
6,125,583 A 10/2000 Murray et al.
6,130,614 A 10/2000 Miller
6,145,918 A 11/2000 Wilbanks, II
6,157,090 A 12/2000 Vogel
6,181,024 B1 1/2001 Geil
6,198,995 B1 3/2001 Settles et al.
6,241,294 B1 6/2001 Young et al.
6,247,343 B1 6/2001 Weiss et al.
6,256,932 B1 7/2001 Jyawook et al.
6,271,745 B1 8/2001 Anazi et al.
6,341,448 B1 1/2002 Murray
6,361,091 B1 3/2002 Weschler
6,405,485 B1 6/2002 Itami et al.
6,441,512 B1 8/2002 Jakel et al.
6,460,905 B2 10/2002 Suss
6,470,719 B1 10/2002 Franz et al.
6,480,098 B2 11/2002 Flick
6,515,377 B1 2/2003 Uberlein et al.
6,523,376 B2 2/2003 Baukholt et al.
6,550,826 B2 4/2003 Fukushima et al.
6,554,328 B2 4/2003 Cetnar et al.
6,556,900 B1 4/2003 Brynielsson
6,602,077 B2 8/2003 Kasper et al.
6,606,492 B1 8/2003 Losey
6,629,711 B1 10/2003 Gleason et al.
6,639,161 B2 10/2003 Meagher et al.
6,657,537 B1 12/2003 Hauler
6,659,515 B2 12/2003 Raymond et al.
6,701,671 B1 3/2004 Fukumoto et al.
6,712,409 B2 3/2004 Monig
6,715,806 B2 4/2004 Arlt et al.
6,734,578 B2 5/2004 Konno et al.
6,740,834 B2 5/2004 Sueyoshi et al.
6,768,413 B1 7/2004 Kemmann et al.
6,779,372 B2 8/2004 Arlt et al.
6,783,167 B2 8/2004 Bingle et al.
6,786,070 B1 9/2004 Dimig et al.
6,794,837 B1 9/2004 Whinnery et al.
6,825,752 B2 11/2004 Nahata et al.
6,829,357 B1 12/2004 Alrabady et al.
6,843,085 B2 1/2005 Dimig
6,854,870 B2 2/2005 Huizenga
6,879,058 B2 4/2005 Lorenz et al.
6,883,836 B2 4/2005 Breay et al.
6,883,839 B2 4/2005 Belmond et al.
6,914,346 B2 7/2005 Girard
6,923,479 B2 8/2005 Aiyama et al.
6,933,655 B2 8/2005 Morrison et al.
6,948,978 B2 9/2005 Schofield
7,005,959 B2 2/2006 Amagasa
7,038,414 B2 5/2006 Daniels et al.
7,055,997 B2 6/2006 Baek
7,062,945 B2 6/2006 Saitoh et al.
7,070,018 B2 7/2006 Kachouh
7,070,213 B2 7/2006 Willats et al.
7,090,285 B2 8/2006 Markevich et al.
7,091,823 B2 8/2006 Ieda et al.
7,091,836 B2 8/2006 Kachouh et al.
7,097,226 B2 8/2006 Bingle et al.
7,106,171 B1 9/2006 Burgess
7,108,301 B2 9/2006 Louvel
7,126,453 B2 10/2006 Sandau et al.
7,145,436 B2 12/2006 Ichikawa et al.
7,161,152 B2 1/2007 Dipoala
7,170,253 B2 1/2007 Spurr et al.
7,173,346 B2 2/2007 Aiyama et al.
7,176,810 B2 2/2007 Inoue
7,180,400 B2 2/2007 Amagasa
7,192,076 B2 3/2007 Ottino

(56) References Cited

U.S. PATENT DOCUMENTS 7,204,530 B2 4/2007 Lee
7,205,777 B2 4/2007 Schultz et al.
7,221,255 B2 5/2007 Johnson et al.
7,222,459 B2 5/2007 Taniyama
7,248,955 B2 7/2007 Hein et al.
7,263,416 B2 8/2007 Sakurai et al.
7,270,029 B1 9/2007 Papanikolaou et al.
7,325,843 B2 2/2008 Coleman et al.
7,342,373 B2 3/2008 Newman et al.
7,360,803 B2 4/2008 Parent et al.
7,363,788 B2 4/2008 Dimig et al.
7,375,299 B1 5/2008 Pudney
7,399,010 B2 7/2008 Hunt et al.
7,446,656 B2 11/2008 Steegmann
7,576,631 B1 8/2009 Bingle et al.
7,642,669 B2 1/2010 Spurr
7,686,378 B2 3/2010 Gisler et al.
7,688,179 B2 3/2010 Kurpinski et al.
7,705,722 B2 4/2010 Shoemaker et al.
7,747,286 B2 6/2010 Conforti
7,780,207 B2 8/2010 Gotou et al.
7,791,218 B2 9/2010 Mekky et al.
7,926,385 B2 4/2011 Papanikolaou et al.
7,931,314 B2 4/2011 Nitawaki et al.
7,937,893 B2 5/2011 Pribisic
8,028,375 B2 10/2011 Nakaura et al.
8,093,987 B2 1/2012 Kurpinski et al.
8,126,450 B2 2/2012 Howarter et al.
8,141,296 B2 3/2012 Bem
8,141,916 B2 3/2012 Tomaszewski et al.
8,169,317 B2 5/2012 Lemerand et al.
8,193,462 B2 6/2012 Zanini et al.
8,224,313 B2 7/2012 Howarter et al.
8,376,416 B2 2/2013 Arabia, Jr. et al.
8,398,128 B2 3/2013 Arabia et al.
8,405,515 B2 3/2013 Ishihara et al.
8,419,114 B2 4/2013 Fannon
8,451,087 B2 5/2013 Krishnan et al.
8,454,062 B2 6/2013 Rohlfing et al.
8,474,889 B2 7/2013 Reifenberg et al.
8,532,873 B1 9/2013 Bambenek
8,534,101 B2 9/2013 Mette et al.
8,544,901 B2 10/2013 Krishnan et al.
8,573,657 B2 11/2013 Papanikolaou et al.
8,616,595 B2 12/2013 Wellborn, Sr. et al.
8,648,689 B2 2/2014 Hathaway et al.
8,746,755 B2 6/2014 Papanikolaou et al.
8,826,596 B2 9/2014 Tensing
8,833,811 B2 9/2014 Ishikawa
8,903,605 B2 12/2014 Bambenek
8,915,524 B2 12/2014 Charnesky
8,963,701 B2 2/2015 Rodriguez
8,965,287 B2 2/2015 Lam
9,076,274 B2 7/2015 Kamiya
9,159,219 B2 10/2015 Magner et al.
9,184,777 B2 11/2015 Esselink et al.
9,187,012 B2 11/2015 Sachs et al.
9,189,900 B1 11/2015 Penilla et al.
9,260,882 B2 2/2016 Krishnan et al.
9,284,757 B2 3/2016 Kempel
9,405,120 B2 8/2016 Graf
9,409,579 B2 8/2016 Eichin et al.
9,416,565 B2 8/2016 Papanikolaou et al.
9,518,408 B1 12/2016 Krishnan
9,546,502 B2 1/2017 Lange
9,551,166 B2 1/2017 Patel et al.
9,725,069 B2 8/2017 Krishnan
9,777,528 B2 10/2017 Elie et al.
9,797,178 B2 10/2017 Elie et al.
9,834,964 B2 12/2017 Van Wiemeersch et al.
9,845,071 B1 12/2017 Krishnan
9,903,142 B2 2/2018 Van Wiemeersch et al.
9,909,344 B2 3/2018 Krishnan et al.
9,957,737 B2 5/2018 Patel et al.
2001/0005078 A1 6/2001 Fukushima et al.
2001/0030871 A1 10/2001 Anderson
2002/0000726 A1 1/2002 Zintler
2002/0111844 A1 8/2002 Vanstory et al.
2002/0121967 A1 9/2002 Bowen et al.
2002/0186144 A1 12/2002 Meunier
2003/0009855 A1 1/2003 Budzynski
2003/0025337 A1 2/2003 Suzuki et al.
2003/0038544 A1 2/2003 Spurr
2003/0101781 A1 6/2003 Budzynski et al.
2003/0107473 A1 6/2003 Pang et al.
2003/0111863 A1 6/2003 Weyerstall et al.
2003/0132667 A1* 7/2003 Willats ..... E05B 81/76 307/10.1
2003/0139155 A1 7/2003 Sakai
2003/0172695 A1 9/2003 Buschmann
2003/0182863 A1 10/2003 Mejean et al.
2003/0184098 A1 10/2003 Aiyama
2004/0061462 A1 4/2004 Bent et al.
2004/0093155 A1 5/2004 Simonds et al.
2004/0124708 A1 7/2004 Giehler et al.
2004/0195845 A1 10/2004 Chevalier
2004/0217601 A1 11/2004 Gamault et al.
2005/0057047 A1* 3/2005 Kachouh ..... E05B 81/14 292/201
2005/0068712 A1* 3/2005 Schulz ..... E05B 81/78 361/287
2005/0216133 A1 9/2005 MacDougall et al.
2005/0218913 A1 10/2005 Inaba
2006/0056663 A1 3/2006 Call
2006/0100002 A1 5/2006 Luebke et al.
2006/0186987 A1 8/2006 Wilkins
2007/0001467 A1 1/2007 Muller et al.
2007/0090654 A1 4/2007 Eaton
2007/0115191 A1 5/2007 Hashiguchi et al.
2007/0120645 A1 5/2007 Nakashima
2007/0126243 A1 6/2007 Papanikolaou et al.
2007/0132553 A1 6/2007 Nakashima
2007/0170727 A1 7/2007 Kohlstrand et al.
2008/0021619 A1 1/2008 Steegmann et al.
2008/0060393 A1 3/2008 Johansson et al.
2008/0068129 A1 3/2008 Ieda et al.
2008/0129446 A1 6/2008 Vader
2008/0143139 A1 6/2008 Bauer et al.
2008/0202912 A1 8/2008 Boddie et al.
2008/0203737 A1 8/2008 Tomaszewski et al.
2008/0211623 A1 9/2008 Scheurich
2008/0217956 A1 9/2008 Gschweng et al.
2008/0224482 A1 9/2008 Cumbo et al.
2008/0230006 A1 9/2008 Kirchoff et al.
2008/0250718 A1 10/2008 Papanikolaou et al.
2008/0296927 A1 12/2008 Gisler et al.
2008/0303291 A1 12/2008 Spurr
2008/0307711 A1 12/2008 Kern et al.
2009/0033104 A1 2/2009 Konchan et al.
2009/0033477 A1 2/2009 Illium et al.
2009/0145181 A1 6/2009 Pecoul et al.
2009/0160211 A1 6/2009 Krishnan et al.
2009/0177336 A1 7/2009 McClellan et al.
2009/0240400 A1 9/2009 Lachapelle et al.
2009/0257241 A1 10/2009 Meinke et al.
2010/0007463 A1 1/2010 Dingman et al.
2010/0005233 A1 3/2010 Arabia et al.
2010/0052337 A1 3/2010 Arabia, Jr. et al.
2010/0060505 A1 3/2010 Witkowski
2010/0097186 A1 4/2010 Wielebski
2010/0175945 A1 7/2010 Helms
2010/0235057 A1 9/2010 Papanikolaou et al.
2010/0235058 A1 9/2010 Papanikolaou et al.
2010/0235059 A1 9/2010 Krishnan et al.
2010/0237635 A1 9/2010 Ieda et al.
2010/0253535 A1 10/2010 Thomas
2010/0265034 A1 10/2010 Cap et al.
2010/0315267 A1 12/2010 Chung et al.
2011/0041409 A1 2/2011 Newman et al.
2011/0060480 A1 3/2011 Mottla et al.
2011/0148575 A1 6/2011 Sobecki et al.
2011/0154740 A1 6/2011 Matsumoto et al.
2011/0180350 A1 7/2011 Thacker
2011/0203181 A1 8/2011 Magner et al.

(56) References Cited

U.S. PATENT DOCUMENTS

| | | | |
|---|---|---|---|
| 2011/0203336 | A1 | 8/2011 | Mette et al. |
| 2011/0227351 | A1 | 9/2011 | Grosdemouge |
| 2011/0248862 | A1 | 10/2011 | Budampati |
| 2011/0252845 | A1 | 10/2011 | Webb et al. |
| 2011/0285503 | A1* | 11/2011 | Schuessler ..... E05B 85/12 340/5.72 |
| 2011/0313937 | A1 | 12/2011 | Moore, Jr. et al. |
| 2012/0119524 | A1 | 5/2012 | Bingle et al. |
| 2012/0154292 | A1 | 6/2012 | Zhao et al. |
| 2012/0180394 | A1 | 7/2012 | Shinohara |
| 2012/0205925 | A1 | 8/2012 | Muller et al. |
| 2012/0228886 | A1 | 9/2012 | Muller et al. |
| 2012/0252402 | A1 | 10/2012 | Jung |
| 2013/0033362 | A1* | 2/2013 | Hourne ..... H03K 17/962 340/5.72 |
| 2013/0069761 | A1 | 3/2013 | Tieman |
| 2013/0079984 | A1 | 3/2013 | Aerts et al. |
| 2013/0104459 | A1 | 5/2013 | Patel et al. |
| 2013/0127180 | A1 | 5/2013 | Heberer et al. |
| 2013/0138303 | A1 | 5/2013 | McKee et al. |
| 2013/0207794 | A1 | 8/2013 | Patel |
| 2013/0282226 | A1 | 10/2013 | Pollmann |
| 2013/0295913 | A1 | 11/2013 | Matthews, III et al. |
| 2013/0311046 | A1 | 11/2013 | Heberer et al. |
| 2013/0321065 | A1 | 12/2013 | Salter et al. |
| 2013/0325521 | A1 | 12/2013 | Jameel |
| 2014/0000165 | A1 | 1/2014 | Patel et al. |
| 2014/0007404 | A1 | 1/2014 | Krishnan et al. |
| 2014/0015637 | A1 | 1/2014 | Dassanakake et al. |
| 2014/0088825 | A1 | 3/2014 | Lange et al. |
| 2014/0129113 | A1 | 5/2014 | Van Wiemeersch et al. |
| 2014/0150581 | A1 | 6/2014 | Scheuring et al. |
| 2014/0156111 | A1 | 6/2014 | Ehrman |
| 2014/0188999 | A1 | 7/2014 | Leonard et al. |
| 2014/0200774 | A1 | 7/2014 | Lange et al. |
| 2014/0227980 | A1 | 8/2014 | Esselink et al. |
| 2014/0242971 | A1 | 8/2014 | Aladenize et al. |
| 2014/0245666 | A1 | 9/2014 | Ishida et al. |
| 2014/0256304 | A1 | 9/2014 | Frye et al. |
| 2014/0278599 | A1 | 9/2014 | Reh |
| 2014/0293753 | A1 | 10/2014 | Pearson |
| 2014/0338409 | A1 | 11/2014 | Kraus et al. |
| 2014/0347163 | A1 | 11/2014 | Banter et al. |
| 2015/0001926 | A1 | 1/2015 | Kageyama et al. |
| 2015/0048927 | A1 | 2/2015 | Simmons |
| 2015/0059250 | A1 | 3/2015 | Miu |
| 2015/0084739 | A1 | 3/2015 | Lemoult et al. |
| 2015/0149042 | A1 | 5/2015 | Cooper et al. |
| 2015/0161832 | A1 | 6/2015 | Esselink et al. |
| 2015/0197205 | A1 | 7/2015 | Xiong |
| 2015/0240548 | A1 | 8/2015 | Bendel et al. |
| 2015/0294518 | A1 | 10/2015 | Peplin |
| 2015/0330112 | A1 | 11/2015 | Van Wiemeersch et al. |
| 2015/0330113 | A1 | 11/2015 | Van Wiemeersch et al. |
| 2015/0330114 | A1 | 11/2015 | Linden et al. |
| 2015/0330117 | A1 | 11/2015 | Van Wiemeersch et al. |
| 2015/0360545 | A1 | 12/2015 | Nanla |
| 2015/0371031 | A1 | 12/2015 | Ueno et al. |
| 2016/0060909 | A1 | 3/2016 | Krishnan et al. |
| 2016/0130843 | A1 | 5/2016 | Bingle |
| 2016/0138306 | A1 | 5/2016 | Krishnan et al. |
| 2016/0153216 | A1 | 6/2016 | Funahashi et al. |
| 2016/0326779 | A1 | 11/2016 | Papanikolaou et al. |
| 2017/0014039 | A1 | 1/2017 | Pahlevan et al. |
| 2017/0074006 | A1 | 3/2017 | Patel et al. |
| 2017/0247016 | A1 | 8/2017 | Krishnan |
| 2017/0270490 | A1 | 9/2017 | Penilla et al. |
| 2017/0306662 | A1 | 10/2017 | Och et al. |
| 2017/0349146 | A1 | 12/2017 | Krishnan |
| 2018/0038147 | A1 | 2/2018 | Linden et al. |
| 2018/0051493 | A1 | 2/2018 | Krishnan et al. |
| 2018/0051498 | A1 | 2/2018 | Van Wiemeersch et al. |
| 2018/0058128 | A1 | 3/2018 | Khan et al. |
| 2018/0065598 | A1 | 3/2018 | Krishnan |
| 2018/0080270 | A1 | 3/2018 | Khan et al. |
| 2018/0128022 | A1 | 5/2018 | Van Wiemeersh et al. |

FOREIGN PATENT DOCUMENTS

| | | | |
|---|---|---|---|
| CN | 101527061 | A | 9/2009 |
| CN | 201567872 | U | 9/2010 |
| CN | 101932466 | A | 12/2010 |
| CN | 201915717 | U | 8/2011 |
| CN | 202200933 | U | 4/2012 |
| CN | 202686247 | U | 1/2013 |
| CN | 103206117 | A | 7/2013 |
| CN | 103264667 | A | 8/2013 |
| CN | 203511548 | U | 4/2014 |
| CN | 204326814 | U | 5/2015 |
| DE | 4403655 | A1 | 8/1995 |
| DE | 19620059 | A1 | 11/1997 |
| DE | 19642698 | A2 | 11/2000 |
| DE | 19642698 | C2 | 11/2000 |
| DE | 10212794 | A1 | 6/2003 |
| DE | 20121915 | U1 | 11/2003 |
| DE | 10309821 | A1 | 9/2004 |
| DE | 102005041551 | A1 | 3/2007 |
| DE | 102006029774 | A1 | 1/2008 |
| DE | 102006041928 | A1 | 3/2008 |
| DE | 102010052582 | A1 | 5/2012 |
| DE | 102011051165 | A1 | 12/2012 |
| DE | 102015101164 | A1 | 7/2015 |
| DE | 102014107809 | A1 | 12/2015 |
| EP | 0372791 | A2 | 6/1990 |
| EP | 0694664 | A1 | 1/1996 |
| EP | 1162332 | A1 | 12/2001 |
| EP | 1284334 | A1 | 2/2003 |
| EP | 1288403 | A2 | 3/2003 |
| EP | 1284334 | A1 | 9/2003 |
| EP | 1460204 | A2 | 9/2004 |
| EP | 1465119 | A1 | 10/2004 |
| EP | 1338731 | A2 | 2/2005 |
| EP | 1944436 | A2 | 7/2008 |
| EP | 2053744 | A2 | 4/2009 |
| EP | 2314803 | A2 | 4/2011 |
| FR | 2698838 | A1 | 6/1994 |
| FR | 2783547 | A1 | 3/2000 |
| FR | 2841285 | A1 | 12/2003 |
| FR | 2948402 | A1 | 7/2009 |
| FR | 2955604 | A1 | 7/2011 |
| GB | 2402840 | A | 12/2004 |
| GB | 2496754 | A | 5/2013 |
| JP | 52255256 | A | 11/1987 |
| JP | 05059855 | A | 3/1993 |
| JP | 06167156 | A | 6/1994 |
| JP | 306185250 | A | 7/1994 |
| JP | 20000064685 | A | 2/2000 |
| JP | 2000314258 | A | 11/2000 |
| JP | 2007138500 | A | 6/2007 |
| KR | 20030025738 | A | 3/2003 |
| KR | 20120108580 | A | 10/2012 |
| WO | 0123695 | A1 | 4/2001 |
| WO | 03095776 | A1 | 11/2003 |
| WO | 2013111615 | A1 | 8/2013 |
| WO | 2013146918 | A1 | 10/2013 |
| WO | 2014146186 | A1 | 9/2014 |

OTHER PUBLICATIONS

Department of Transportation, "Federal Motor Vehicle Safety Standards; Door Locks and Door Retention Components and Side Impact Protection," http://www.nhtsa.gov/cars/rules/rulings/DoorLocks/DoorLocks_NPRM.html#VI_C, 23 pages, Aug. 28, 2010.

Zipcar.com, "Car Sharing from Zipcar: How Does car Sharing Work?" Feb. 9, 2016, 6 pages.

PRWEB, "Keyfree Technologies Inc. Launches the First Digital Car Key," Jan. 9, 2014, 3 pages.

"Push Button to open your car door" Online video clip. YouTube, Mar. 10, 2010. 1 page.

(56) References Cited

OTHER PUBLICATIONS

Car of the Week: 1947 Lincoln convertible by: bearnest May 29, 2012 http://www.oldcarsweekly.com/car-of-the-week/car-of-the-week-1947-lincoln-convertible. 7 pages.
U.S. Appl. No. 14/276,415, Office Action dated Mar. 28, 2018, 19 pages.
U.S. Appl. No. 12/402,744, Office Action dated Oct. 23, 2013, 7 pages.
U.S. Appl. No. 12/402,744, Advisory Action dated Jan. 31, 2014, 2 pages.
U.S. Appl. No. 14/280,035, filed May 16, 2014, entitled "Powered Latch System for Vehicle Doors and Control System Therefor."
U.S. Appl. No. 14/281,998, filed May 20, 2014, entitled "Vehicle Door Handle and Powered Latch System."
U.S. Appl. No. 14/282,224, filed May 20, 2014, entitled "Powered Vehicle Door Latch and Exterior Handle With Sensor."
George Kennedy, "Keyfree app replaces conventional keys with your smart phone," website, Jan. 5, 2015, 2 pages.
Hyundai Motor India Limited, "Hyundai Care," website, Dec. 8, 2015, 3 pages.
Keyfree Technologies Inc., "Keyfree," website, Jan. 10, 2014, 2 pages.
Bryan Laviolette, "GM's New App Turns Smartphones into Virtual Keys," Article, Jul. 22, 2010, 2 pages.
General Motors Corporation, 2006 Chevrolet Corvette Owner Manual, © 2005 General Motors Corporation, 4 pages.
General Motors LLC, 2013 Chevrolet Corvette Owner Manual, 2012, 17 pages.
General Motors, "Getting to Know Your 2014 Corvette," Quick Reference Guide, 2013, 16 pages.
InterRegs Ltd., Federal Motor Vehicle Safety Standard, "Door Locks and Door Retention Components," 2012, F.R. vol. 36 No. 232—Feb. 12, 1971, 23 pages.
Ross Downing, "How to Enter & Exit a Corvette With a Dead Battery," YouTube video http://www.youtube.com/watch?v=DLDqmGQU6L0, Jun. 6, 2011, 1 page.
Jeff Glucker, "Friends videotape man 'trapped' inside C6 Corette with dead battery," YouTube via Corvett Online video hittp://www.autoblog.com/2011/05/14/friends-videotape-man-trapped-inside-c6-corvette-with-dead-bat/, May 14, 2011, 1 page.
Don Roy, "ZR1 Owner Calls 911 After Locking Self in Car," website http://www.corvetteonline.com/news/zr1-owner-calls-911-after-locking-self-in-car/, Apr. 13, 2011, 2 pages.
Zach Bowman, "Corvette with dead battery traps would-be thief," website http://www.autoblog.com/2011/10/25/corvette-with-dead-battery-traps-would-be-thief/, Oct. 25, 2011, 2 pages.
U.S. Appl. No. 14/468,634, filed Aug. 26, 2014, 15 pages.
U.S. Appl. No. 13/608,303, filed Sep. 10, 2012, 15 pages.
U.S. Appl. No. 14/281,998, filed May 20, 2014, 20 pages.
U.S. Appl. No. 14/282,224, filed May 20, 2014, 15 pages.
U.S. Appl. No. 14/276,415, filed May 13, 2014, 18 pages.
Office Action dated Mar. 10, 2017, U.S. Appl. No. 15/174,206, filed Jun. 6, 2016, 17 pages.
Hyundai Bluelink, "Send Directions to your car," Link to App, 2015, 3 pages.

* cited by examiner

ELECTRONIC VEHICLE ACCESS CONTROL SYSTEM

CROSS-REFERENCE TO RELATED APPLICATIONS

This application is continuation of U.S. patent application Ser. No. 14/281,998, which was filed on May 20, 2014, entitled "VEHICLE DOOR HANDLE AND POWERED LATCH SYSTEM," now U.S. Pat. No. 9,903,142, issued on Feb. 27, 2018, which is a continuation-in-part of U.S. patent application Ser. No. 14/280,035, which was filed on May 16, 2014, entitled "POWERED LATCH SYSTEM FOR VEHICLE DOORS AND CONTROL SYSTEM THEREFOR," now U.S. Pat. No. 10,119,308, issued on Nov. 6, 2018, which is a continuation-in-part of U.S. patent application Ser. No. 14/276,415, which was filed on May 13, 2014, entitled "CUSTOMER COACHING METHOD FOR LOCATION OF E-LATCH BACKUP HANDLES," the entire disclosures of each of which are incorporated herein by reference. This application is also related to U.S. patent application Ser. No. 14/282,224, filed on May 20, 2014, entitled "POWERED VEHICLE DOOR LATCH AND EXTERIOR HANDLE WITH SENSOR," now U.S. Pat. No. 9,834,964, the entire contents of which are incorporated herein by reference.

FIELD OF THE INVENTION

The present invention generally relates to doors for motor vehicles, and more particularly, to a door handle having sensors and/or switches that may be utilized to control operation of a powered door latch.

BACKGROUND OF THE INVENTION

Conventional door latches typically include a "claw" that engages a striker to retain the door in a closed position. A pawl selectively retains the claw in an engaged position to prevent the vehicle from opening. The pawl is typically mechanically connected to interior and exterior door handles whereby movement of the handles unlatches the latch by shifting the pawl to a released (unlatched) position, thereby permitting the claw to move and disengage from the striker.

Powered door latches ("e-latches") have also been developed. Powered door latches may be unlatched by actuating an electrical "unlatch" switch. Actuation of the unlatch switch causes an electric motor to shift a pawl of the powered latch mechanism to a released (unlatched) position that allows the "claw" to release from a striker. However, known e-latch arrangements may suffer from various drawbacks such as unintentional or accidental trigger of the release switch by the customer.

SUMMARY OF THE INVENTION

One aspect of the present invention is a vehicle door including a door structure having an interior surface. The vehicle door also includes a powered latch mechanism that can be actuated to shift from a latched configuration to an unlatched configuration. An interior door handle is disposed on the door structure. The handle includes a graspable portion that is spaced apart from the interior surface of the door structure to define a gap. The graspable portion of the interior door handle has a first side that generally faces the interior surface, and a second side that generally faces away from the interior surface. First sensors are disposed on the first side of the graspable portion. The first sensors are configured to detect the presence of a user's hand. Second sensors on the second side of the graspable portion are configured to detect the presence of a user's hand. The vehicle door further includes an unlatch switch on the door structure. The powered latch mechanism does not unlatch unless the unlatch switch is actuated when the first and second sensors also detect the presence of a user's hand.

Another aspect of the present invention is a vehicle door including a door structure and an elongated interior door handle having capacitive sensors disposed on opposite sides thereof. A manually actuated switch is disposed at an end of the elongated interior door handle. The vehicle door also includes a powered latch and a controller that is configured to unlatch the powered latch if the capacitive sensors detect a hand on the opposite sides of the handle, and if the switch is actuated within a predefined time interval of detecting a hand.

Another aspect of the present invention is a method of controlling a powered door latch of a vehicle. The method includes providing a door structure having an interior handle and a powered latch configured to selectively retain the door in a closed position. Sensors are provided on opposite sides of the interior handle, and the powered latch is unlatched only if the sensors on opposite sides of the handle detect a user's hand. The door may include a switch, and the powered latch may be unlatched only if the switch is actuated within a predefined time interval of detection of a user's hand by the sensors.

These and other aspects, objects, and features of the present invention will be understood and appreciated by those skilled in the art upon studying the following specification, claims, and appended drawings.

BRIEF DESCRIPTION OF THE DRAWINGS

In the drawings:

FIG. 1;

DETAILED DESCRIPTION OF THE PREFERRED EMBODIMENTS

Figure 1:
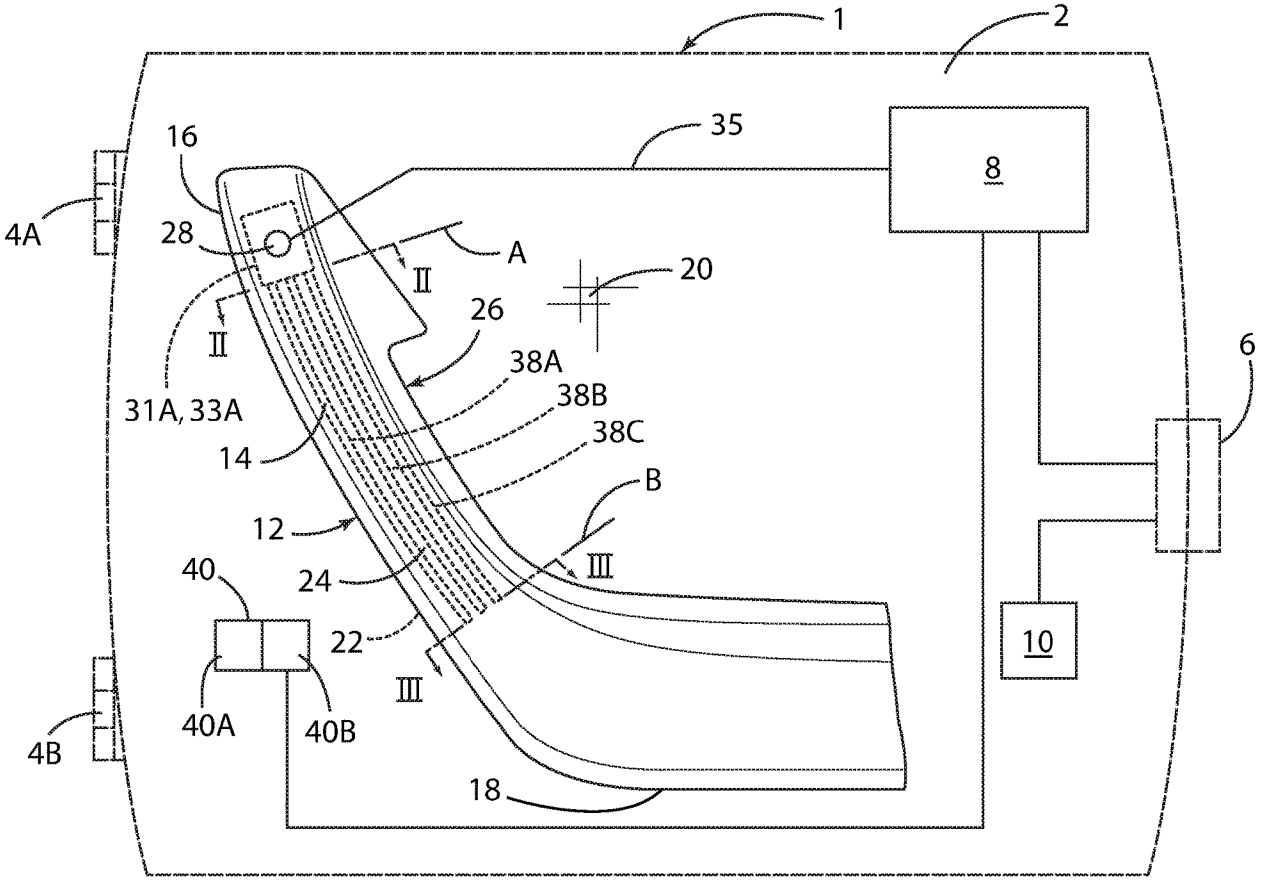
FIG. 1 is a partially schematic view of a vehicle door having an interior handle and powered latch according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a vehicle door 1 includes a door structure 2 that may be movably mounted to a primary vehicle structure by hinges 4A and 4B in a known manner. The vehicle door 1 may include a powered latch 6 that is operably connected to a controller 8. It will be understood that controller 8 may comprise one or more programmable controllers, circuits, or other suitable devices. For example, controller 8 may comprise a controller that is integrated into powered latch 6, and controller 8 may further include other controllers that are integrated into the vehicle. Further, controller 8 may comprise a vehicle wide network and able to communicate with other powered latches 6 of additional doors. The vehicle wide network may include modules and/or sensors that provide data concerning various vehicle operating parameters such as vehicle speed, ignition switch status, and notification of a crash event in progress.

Figure 2:
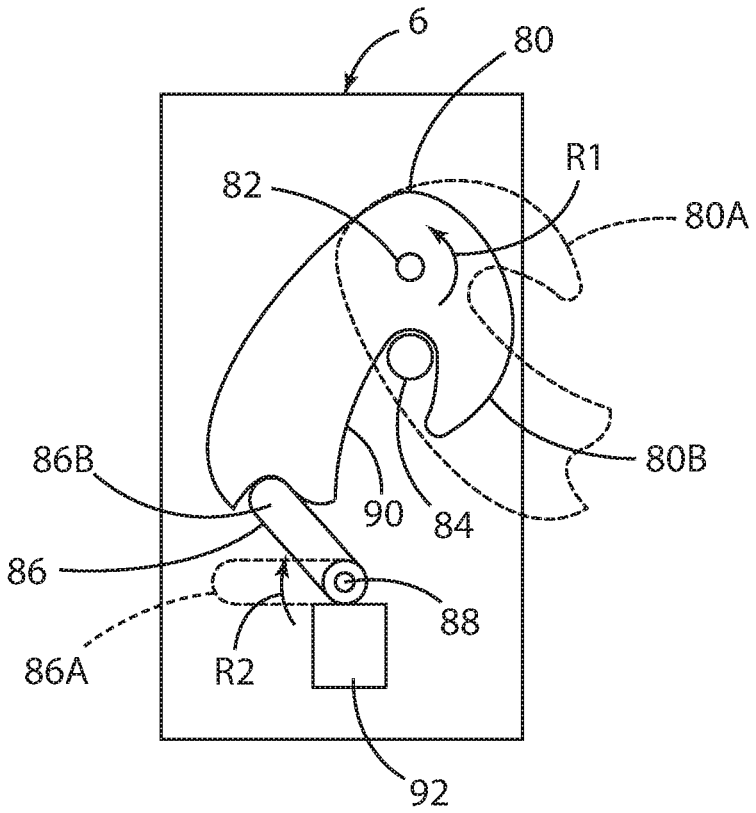
FIG. 2 is a schematic drawing of a powered latch.

With further reference to FIG. 2, powered latch 6 may include a claw 80 that pivots about a pin 82. In use, when door 1 is open, claw 80 will typically be in an extended position 80A. As the door 1 is closed, surface 90 of claw 80 comes into contact with a striker 84 that is mounted to the vehicle structure. Contact between striker 84 and surface 90 of claw 80 causes the claw 80 to rotate about pin 82 in the direction of the arrow "R1" until the claw 80 reaches the closed position 80B. A pawl 86 is mounted for rotation about a pin 88. Pawl 86 can move between a disengaged or unlatched position 86A and a latched or engaged configuration or position 86B. When claw 80 is in the closed position 80B, and pawl 86 is in the engaged position 86B, pawl 86 prevents rotation of claw 80 to the open position 80A, thereby preventing opening of door 1. Claw 80 may be biased by a spring or the like for rotation in a direction opposite the arrow R1 such that the claw 80 rotates to the open position 80A unless pawl 86 is in the engaged position 86B. Pawl 86 may be biased by a spring or the like in the direction of the arrow R2 such that pawl 86 rotates to the engaged position 86B as claw 80 rotates to the closed position 80B as striker 84 engages claw 80 as door 1 is closed. Latch 6 can be unlatched by rotating pawl 86 in a direction opposite the arrow R2 to thereby permit rotation of claw 80 from the closed position 80B to the open position 80A. A powered actuator such as an electric motor 92 may be operably connected to the pawl 86 to thereby rotate the pawl 86 to the disengaged or unlatched position 86A. Thus, in general, controller 8 can cause powered latch 6 to shift from a latched configuration or state to an unlatched configuration or state by causing powered actuator 92 to rotate pawl 86 from the latched or engaged position 86B to the unlatched configuration or position 86A. However, it will be understood that various types of powered latches may be utilized in the present invention, and the powered latch 6 need not include the claw 80 and powered pawl 86 as shown in FIG. 2. For example, powered actuator 92 could be operably interconnected with the claw 80 utilizing a mechanical device other than pawl 86 to thereby shift the powered latch 6 between latched and unlatched states. In general, vehicle door 1 can be pulled open if powered latch 6 is in an unlatched state, but the powered latch 6 retains the vehicle door 1 in a closed position when the powered latch 6 is in a latched state or configuration. As discussed in more detail below, an unlock switch 40 locks and unlocks powered latch 6.

Figure 3:
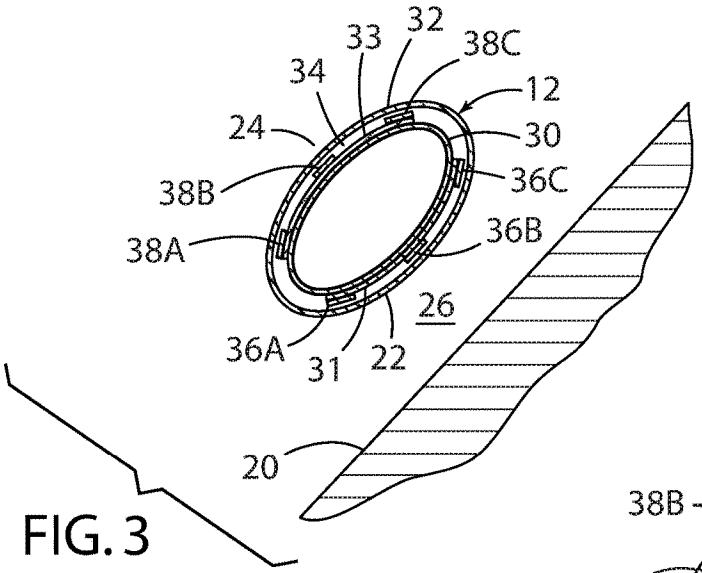
FIG. 3 is a fragmentary cross sectional view taken along the line II-II.
Figure 4:
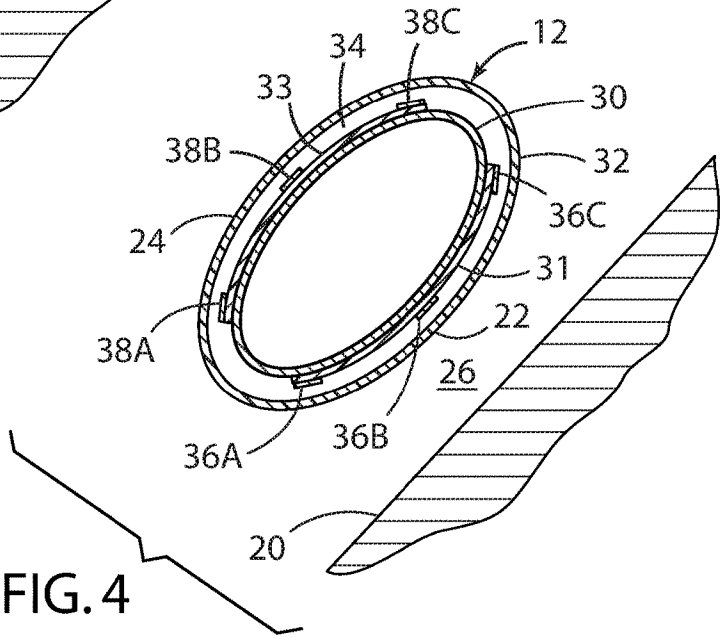
FIG. 4 is a fragmentary cross sectional view taken along the line FIG. 1.

Referring again to FIG. 1, the door 1 includes an interior door handle 12 that includes an elongated central portion 14 having a first or inner opposite side 22 (see also FIGS. 3 and 4) that faces interior surface 20 of door structure 2. The elongated central portion 14 of handle 12 also includes a second or outer opposite side 24 that generally faces away from the interior surface of the door 20. A space 26 is defined between the central portion 14 of handle 12 and the outer surface 20 of door structure 2. In use, a user can insert a portion of his/her hand into the space 26, and grasp the door handle 12 by wrapping his/her fingers around the central portion 14 of handle 12. As discussed in more detail below, a user can then push on an unlatch switch or button 28 with his or her thumb to provide a signal to controller 8 to unlatch the powered latch 6 if specified criteria are satisfied.

Referring again to FIGS. 3 and 4, door handle 12 may include an inner structure 30, an outer cover 32, and an intermediate space 34 between the inner structure 30 and outer cover 32. The inner structure 30 may comprise, for example, a rigid, tubular metal structure, and the outer cover 32 may comprise a flexible polymer, cloth, or other suitable material. The intermediate space 34 may be completely or partially filled with a solid polymer material, resilient foam, or other suitable material. Alternatively, the outer cover 34 may comprise a solid, one-piece molded component that fills space 34.

Handle 12 also includes first or inner capacitive sensors 36A, 36B, 36C that extend along inner side 22 of the central portion 14 of handle 12. The handle 12 also includes second or outer capacitive sensors/electrodes 38A, 38B, and 38C that extend along the second or outer side 24 of central portion 14 of handle 12. The capacitive sensors 36A-36C and 38A-38C may comprise elongated strips as shown in FIG. 1. The capacitive sensors 36A-36C (FIGS. 3 and 4) may be mounted on curved printed circuit boards 31, and the capacitive sensors 38A-38C may be mounted on curved printed circuit boards 33. The printed circuit boards 31 and 33 may be mounted to the inner structure 30. Circuit boards 31 and 33 may comprise rigid polymer material that is thermoformed or molded to provide a curved shape. Alternatively, the circuit boards 31 and 33 may comprise a flexible material that can be flexed as required to conform to the curvature of inner structure 30. End portions 31A and 33A (FIG. 1) of the printed circuit boards 31 and 33, respectively, may extend towards the end portion 16 of door handle 12. Electrical circuit components (not shown) may be mounted on the end portions 31A and/or 33A of the printed circuit boards 31 and 33, and one or more electrical lines 35 may be utilized to electrically connect the circuit boards 31 and 33 to controller 8. In the illustrated example, the capacitive sensors 36A-36C and 38A-38C generally extend between the lines designated "A" and "B" in FIG. 1. However, it will be understood that the capacitive sensors 36A-36C and 38A-38C may comprise various types of sensors as required for a particular application. For example, push buttons could also be mounted to the inner and outer sides 22 and 24 of handle 12 rather than the capacitive sensors just described. Optical sensors or the like could also be utilized to detect the presence of a hand on handle 12. Still further, a single capacitive sensor could be mounted on the inner side of handle 22, and a single capacitive sensor could be mounted on the outer side 24 of handle 12. Also, additional capacitive sensors/electrodes could be disposed on each side of the handle 12. For example, handle 12 could include six (6) capacitive sensors/electrodes on both the inner side 22 and outer side 24 to provide more sensitivity as to the firmness of the grip. Providing additional sensors or different sensors (e.g. push-button switches) provides additional data that can be utilized by controller 8 to determine if a user is casually grabbing the handle 12 with the intent to exit the vehicle or firmly grabbing the handle 12 to brace themselves for a potential impact or to hold firmly for a tight turn.

As discussed in more detail below, in use, a user grasps the central portion 14 of handle 12. If the user's hand is wrapped around the central portion 14 of handle 12, one or more of the first capacitive sensors 36A-36C and one or more of the second capacitive sensors 38A-38C will detect the presence of the user's hand. If the user presses or otherwise actuates the unlatch switch 28 within a predefined time interval (e.g. 3 seconds) of sensors 36A-36C and 38A-38C both detecting the presence of a user's hand, the controller 8 will cause the powered latch 6 to unlatch. As also discussed in more detail below, additional operating parameters or criteria may also be utilized by controller 8 to determine if powered latch 6 is to be unlatched.

Figure 5:
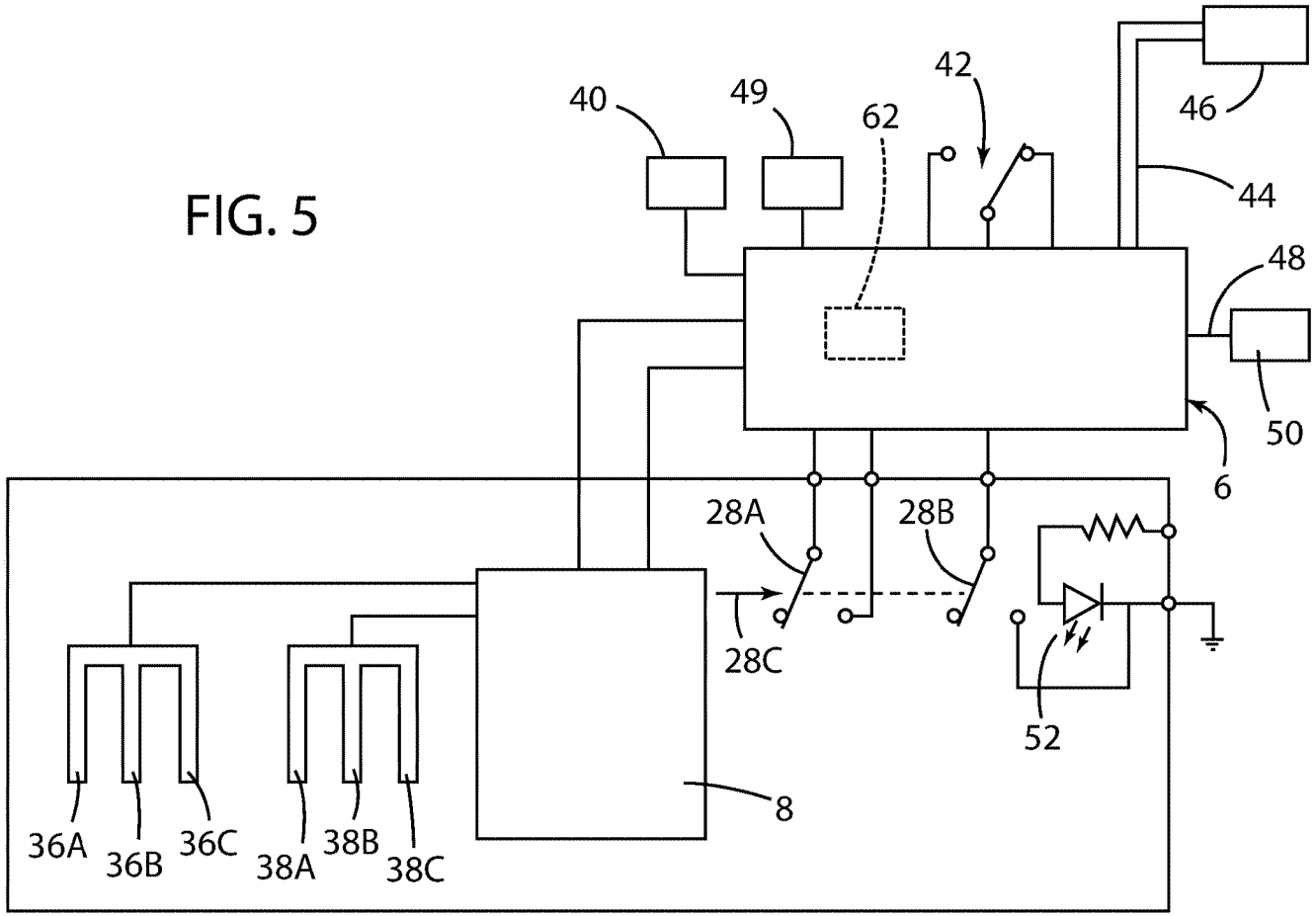
FIG. 5 is an electrical diagram of the door handle and powered latch of FIG. 1.

With further reference to FIG. 5, the powered latch 6 may be operably connected to an exterior unlatch switch 42 of an exterior door handle (not shown). The powered latch 6 may also be connected to exterior control module 46 by lines 44. The exterior unlatch switch 42 and control module 46 provide for unlocking and unlatching of powered latch 6 from an exterior of a vehicle (provided access has been properly authorized) in a manner that is similar to known exterior latch release arrangements for vehicles equipped with powered latches.

As shown in FIG. 5, the unlatch switch 28 may comprise first and second normally open switches 28A and 28B that can be simultaneously closed by pushing switch member 28C. Switch 28 may optionally include an LED 52 that is illuminated if the vehicle headlights are on to assist a user in locating switch 28. Switch 28 may also include an LED (not shown) to indicate status of the switch 28 when closed. For example, the status LED may hold red for a few seconds if no hand was detected by electrodes 36A-36C and/or 38A-38C but show green if a hand was detected by the electrodes. It will be understood that the unlatch switch 28 could comprise other types of switches or it may comprise a sensor. The powered latch 6 is also operably connected to unlock switch 40. Referring again to FIG. 1, the unlock switch 40 may be positioned on interior surface 20 of door structure 2. The unlock switch 40 may be positioned adjacent interior handle 12 on door 1, or the unlock switch 40 may be positioned away from the door handle 12. The powered latch 6 and/or controller 8 may be configured (e.g. programmed) to provide a "locked" and an "unlocked" state. The controller 8 may be programmed to include locked and unlocked states such that predefined inputs to controller 8 are required to cause controller 8 to "unlock" to thereby permit controller 8 to unlatch powered latch 6. The vehicle may also include a lock switch 41 that is packaged adjacent to unlock switch 40. If the powered latch 6 and/or controller 8 is in a locked state, pushing the unlock switch 40 will cause the controller 8 to set its internal door lock status memory state to the unlocked state. If a valid request is made to release powered latch 6, it will be allowed by controller 8 since the controller 8 has a memory state record indicating that the door is unlocked. Conversely, if controller 8 has a memory state record that the door is in the unlocked state, pushing the locked switch 41 will cause the memory state of controller 8 for the door to change to the locked state. Alternatively, the unlock button 40 may comprise a toggle switch that causes the state of the controller 8 to change between locked and unlocked states each time the toggle switch is pressed or actuated.

Powered latch 6 and controller 8 may be operably connected to a vehicle data system 50 through a vehicle network 48. The vehicle data system 50 may include one or more modules and/or sensors that detect the speed of the vehicle. The vehicle data system 50 may also include sensors that detect lateral acceleration of the vehicle. For example, the vehicle data system 50 may include a Restraint Control Module (RCM) having lateral acceleration sensors and/or other sensors (e.g. pressure sensors in the vehicle door 1) that are utilized by the RCM to detect a crash event requiring deployment of the emergency constraints (e.g. airbags). As discussed in more detail below, data concerning the vehicle speed and/or data concerning lateral acceleration and/or other sensor data may be utilized by the powered latch 6 and/or controller 8 to control latching and unlatching of powered latch 6.

Powered latch 6 may include a backup or emergency power supply 62 comprising a battery, capacitors, or other electrical energy storage device. The backup power supply 62 may store enough electrical energy to actuate the powered latch 6 a limited number of times in the event of an emergency or loss of main vehicle power supply 49 or the local door power feed due to an open or shorted wire. Controller 8 may be configured to detect the loss of main vehicle power supply 49, and to utilize backup power supply 62 in the event of a loss of the local power feed or the main vehicle power supply 49.

Referring again to FIG. 5, the controller 8 is operably connected to the capacitive sensors 36A-36C and 38A-38C. As discussed above, controller 8 may be configured to determine if a user has grasped the interior handle 12 based on input from the capacitive sensors 36A-36C and 38A-38C. In general, the electrical signal from the capacitive sensors 36A-36C and 38A-38C may vary due to changes in temperature or other environmental factors. Controller 8 may be configured to recalculate a "baseline" reading for the capacitive sensors 36A-36C and 38A-38C, and compare the baseline value to a present value. In general, if a user grasps the door handle 12, this will cause one or more of the capacitive sensors 36A-36C and 38A-38C to provide a significantly different input voltage to the controller 8 relative to the baseline voltage, and the controller 8 may be configured to determine that a user's hand is present based on changes in inputs from the capacitive sensors. For example, controller 8 may be configured to determine that a user's hand is present if one or more of the first capacitive sensors 36A-36C have a significant change in input voltage at the same time that one or more of the second capacitive sensors 38A-38C also detect a significant change in input voltages. If controller 8 is configured in this manner, if any one of the sensors 38A-38C detects the presence of a hand at the same time as any one of the sensors 36A-36C also detects the presence of a hand, controller 8 will determine that a user has grasped the door handle 12. However, the specific criteria utilized by controller 8 to determine that a user has grasped handle 12 may vary as required for a specific application.

Controller 8 may also be configured to detect a potential crash event based, at least in part, on inputs from one or more of the capacitive sensors. For example, controller 8 may be configured such that simultaneous detection of a user hand by all of the capacitive sensors 36A-36C and 38A-38C indicates a potential crash event. For example, if the vehicle is experiencing a crash, or is about to crash, a user may grasp the door handle 12 tightly, thus causing all of the capacitive sensors 36A-36C and 38A-38C to detect the presence of a user's hand. Thus, simultaneous detection by all six of the capacitive sensors may be interpreted by controller 8 as indicating a potential crash event. If a potential crash event is detected in this manner, controller 8 may be configured to require that unlatch switch 28 be actuated twice within a predefined time interval (e.g. 3 seconds) in order to unlatch the powered latch 6. However, other combinations of detection by capacitive switches 36A-36C and 38A-38C may be construed by controller 8 as a "normal" unlatching situation such that a single actuation of unlatch switch 28 will cause powered latch 6 to unlatch provided that at least one of capacitive sensors 36A-36C detects a user's hand at the same time as at least one of the capacitive sensors 38A-38C also detects a user's hand.

Figure 6:
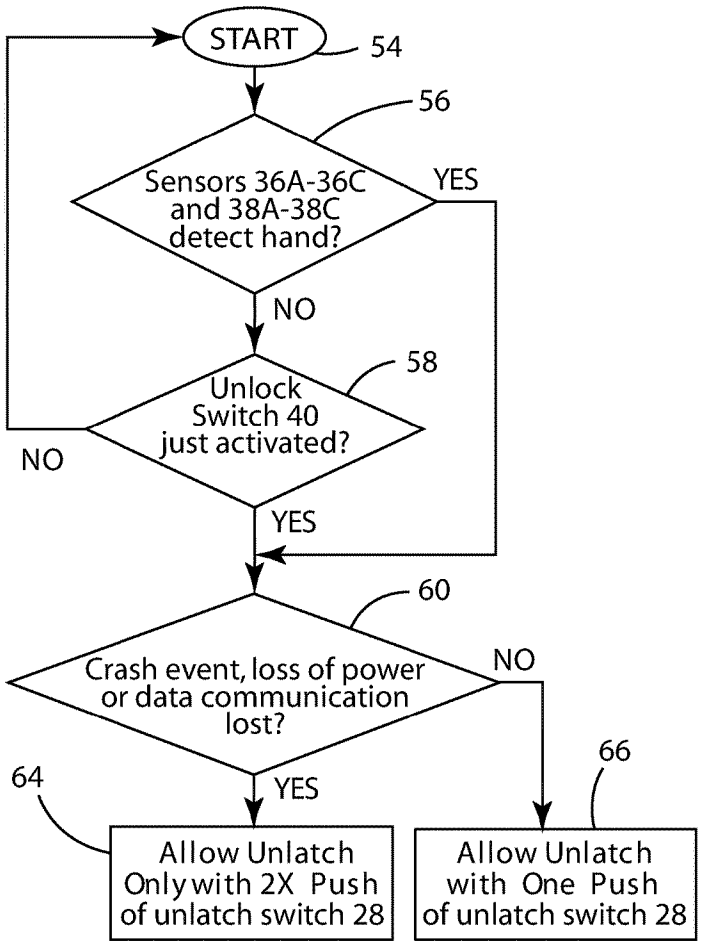
FIG. 6 is a flow chart showing operation of the door handle and powered latch.

Operation of the powered latch 6 is shown schematically in the flow chart of FIG. 6. Initially, at start 54 the powered latch 6 is in a latched configuration such that the vehicle door 1 cannot be opened. At step 56, controller 8 determines if capacitive sensors 36A-36C and 38A-38C have detected the presence of a user's hand. As discussed above, detection of a user's hand could involve various criteria as may be required for a particular application. According to one aspect of the present invention, a user's hand may be detected if at least one of the sensors 36A-36C detects a user's hand at the same time as at least one of the capacitive sensors 38A-38C detects the presence of a user's hand. As discussed above, this detection may be based on a change in input voltage from one or more of the capacitive sensors relative to a baseline voltage.

If a hand is not detected at step 58 the controller 8 determines if the unlock switch 40 was just actuated (e.g. was switch 40 actuated within the last 3 seconds?). If unlock switch 40 was not previously actuated within a predefined time interval, the controller returns to start 54. Referring again to step 56, if controller 8 does detect the presence of a user's hand at step 60, controller 8 determines if the vehicle has experienced a crash event, a loss of power, or a loss of data communication. The crash event may comprise a signal from the RCM module of vehicle data system 50 (FIG. 5). The loss of power may comprise a local loss of power or from main vehicle power supply 49 (FIG. 5). Referring again to FIG. 6, at step 60 a loss of data communication may be detected by controller 8 based on a loss of information from communication bus 48. As discussed above, the vehicle data system 50 may include a restraints control module and/or sensors that measure the vehicle speed. If communications from the vehicle data system 50 are lost, the controller 8 may not be able to determine the vehicle speed, a crash event, or the like. If a crash event, loss of power, or a loss of data communication is determined to have occurred at step 60, controller 8 may be configured to only unlatch powered latch 6 if unlatch switch 20 is pressed twice within a predefined time interval (e.g. 3 seconds) at step 64. If no crash event, loss of power, or loss of data communication is detected at step 60, controller 8 may be configured to unlatch powered latch 6 if unlatch switch 28 is pressed or actuated once as shown at step 66. Controller 8 may be configured to unlatch powered latch 6 only if unlatch switch 28 is actuated while the capacitive sensors detect a hand (step 56) and if the unlatch switch 20 is actuated simultaneously with detection of a hand at step 56. Alternatively, controller 8 may be configured to unlatch powered latch 6 if the capacitive sensors detect a hand (step 56) and if the unlatch switch 28 is actuated within a predefined time interval (e.g. 3 seconds) of the sensors detecting the presence of a hand (step 56). For example, if a user grasps the handle 12 and the sensors 36A-36C and 38A-38C detect the presence of the user's hand at a first time, and the user then releases the handle 12, but pushes or actuates the switch 28 within 3 seconds of the time at which sensors 36A-36C and 38A-38C detect the presence of a hand, the controller 8 could be configured to unlatch the powered latch 6.

Controller 8 may be configured to actuate powered latch 6 according to the logic set forth in tables 1, 1A and 2 as follows:

TABLE 1

NORMAL OPERATION MODE (FIRST CONFIGURATION)
Interior UNLATCH Button Operation per Door
(RCM Event Status OK for over 1 second from Ignition = OFF)

| | | | | Interior Rear Door (First Configuration) | |
|---|---|---|---|---|---|
| MS-CAN Or VPWR | SPEED | LOCK STATUS | Interior Front Door | Child Lock ON | Child Lock OFF |
| OK | Speed < 3 kph | Locked & Alarm Armed | Full Grasp & Push/ actuate switch 28 2 times within 3 seconds | Full Grasp & Push/ actuate switch 28 2 times within 3 seconds | Full Grasp & Push/ actuate switch 28 2 times within 3 seconds |
| | | Locked | Full Grasp & Push/ actuate switch 28 | No Unlatch | Unlock, Full Grasp & Push/actuate switch 28 |
| | | Unlocked | Full Grasp & Push/ actuate switch 28 | No Unlatch | Full Grasp & Push/ actuate switch 28 |
| | 3 kph < Speed < 8 kph | ANY | Full Grasp & Push/ actuate switch 28 | No Unlatch | Full Grasp & Push/ actuate switch 28 |
| | Speed > 8 kph | ANY | Full Grasp & Push/actuate switch 28 | No Unlatch | Full Grasp & Push/ actuate switch 28 |
| Lost | Unknown | Unknown | Full Grasp & Push/ actuate switch 28 2 times within 3 seconds | Full Grasp & Push/ actuate switch 28 2 times within 3 seconds | Full Grasp & Push/ actuate switch 28 2 times within 3 seconds |

TABLE 1 A

| NORMAL OPERATION MODE (SECOND CONFIGURATION) Interior UNLATCH Button Operation per Door (RCM Event Status OK for over 1 second from Ignition = OFF) | | | | | |
|---|---|---|---|---|---|
| | | | | Interior Rear Door (APA) | |
| MS-CAN Or VPWR | SPEED | LOCK STATUS | Interior Front Door | Child Lock ON | Child Lock OFF |
| OK | Speed < 3 kph | Locked & Alarm Armed | Full Grasp & Push/Actuate switch 28 2 times within 3 seconds | Full Grasp & Push/Actuate switch 28 2 times within 3 seconds | Full Grasp & Push/Actuate switch 28 2 times within 3 seconds |
| | | Locked | Full Grasp & Push/Actuate switch 28 | No Unlatch | Full Grasp & Push/Actuate switch 28 |
| | | Unlocked | Full Grasp & Push/Actuate switch 28 | No Unlatch | Full Grasp & Push/Actuate switch 28 |
| | 3 kph < Speed < 8 kph | ANY | Full Grasp & Push/Actuate switch 28 | No Unlatch | Full Grasp & Push/Actuate switch 28 |
| | Speed > 8 kph | ANY | Full Grasp & Push/Actuate switch 28 | No Unlatch | Full Grasp & Push/Actuate switch 28 |
| Lost | Unknown | Unknown | Full Grasp & Push/Actuate switch 28 2 times within 3 seconds | Full Grasp & Push/Actuate switch 28 2X in 3 seconds | Full Grasp & Push/Actuate switch 28 2X in 3 seconds |

TABLE 2

| CRASH OR FUEL CUT OFF MODE Interior UNLATCH Button Operation per Door (RCM Crash/Fuel Event for less than 1 second from Ignition = OFF | | | | | | |
|---|---|---|---|---|---|---|
| | | | | | Interior Rear Door | |
| MS-CAN Or VPWR | SPEED | LOCK STATUS | Exterior Any Door | Interior Front Door | Child Lock ON | Child Lock OFF |
| OK | Speed < 3 kph | Locked & Alarm Armed | State Not Allowed (RCM Off when Security System Armed) | | | |
| | | Locked | No Unlatch | Full Grasp & Push/Actuate switch 28 2 times within 3 seconds | No Unlatch | Full Grasp & Push/Actuate switch 28 2 times within 3 seconds |
| | | Unlocked | No Unlatch | Full Grasp & Push/Actuate switch 28 2 times within 3 seconds | No Unlatch | Full Grasp & Push/Actuate switch 28 2 times within 3 seconds |
| | 3 kph < Speed < 8 kph | ANY | No Unlatch | Full Grasp & Push/Actuate switch 28 2 times within 3 seconds | No Unlatch | Full Grasp & Push/Actuate switch 28 2 times within 3 seconds |
| | Speed > 8 kph | ANY | No Unlatch | Full Grasp & Push/Actuate switch 28 2 times within 3 seconds | No Unlatch | Full Grasp & Push/Actuate switch 28 2 times within 3 seconds |
| Lost | Unknown | Unknown | No Unlatch | Full Grasp & Push/Actuate switch 28 2 times within 3 seconds | Full Grasp & Push/Actuate switch 28 2 times within 3 seconds | Full Grasp & Push/Actuate switch 28 2 times within 3 seconds |

As shown in tables 1 and 1A, the handle and latch system may have a first configuration or operating logic (table 1) or a second configuration or operating logic (table 1A). As can be seen in tables 1 and 1A, the interior rear handle and powered latch of the present invention may be configured differently depending on local laws/regulations. Operation of powered latch 6 may also be configured differently for use in front and rear interior door applications. In general, the same handle 12 (FIG. 1) may be utilized for both front and rear interior door applications in various geographic regions. The controller 8 may be configured to provide the operating logic set forth in tables 1, 1A and/or table 2 as required for a particular application.

In tables 1, 1A and 2, the designation "MS-CAN or VPWR" signifies the status of the vehicle communication bus 48 (FIG. 4) (MS-CAN) and the main vehicle power 49 (VPWR). Thus, controller 8 may be configured to require different inputs to unlatch powered latch 6 if the vehicle communication (MS-CAN) and/or main vehicle power (VPWR) is lost as shown in tables 1, 1A and 2.

In tables 1, 1A, and 2, the term "Full Grasp" generally corresponds to inputs from one or more of sensors 36A-36C and sensors 38A-38C that meet predefined criteria signifying a user has grasped handle 12. For example, the "Full Grasp" criteria could comprise simultaneous sensing by one or more sensors on opposite sides 22 and 24 of handle 12.

Also, as shown in tables 1, 1A and 2, controller 8 may be configured to require different inputs to unlatch the powered latch 6 depending on the vehicle speed. It will be understood that the listed speeds (e.g. 3 kph and 8 kph) are examples of speed criteria that could be utilized. However, the present invention is not limited to these specific speeds, and other speeds could be utilized according to other aspects of the present invention. Similarly, controller 8 may be configured to require actuation of switch 28 twice within 3 seconds under certain operating conditions in order to unlatch the powered latch 6. However, shorter or longer predefined time intervals (e.g. 2 seconds, 4 seconds, etc.) could be utilized according to other aspects of the present invention.

Furthermore, although the sensors 36A-36C and 38A-38C may be capacitive sensors, other sensors or switches positioned on the opposite sides 22 and 24 of door handle 12 (FIGS. 2 and 3) could also be utilized according to other aspects of the present invention. For example, the switches 36 and 38 could comprise mechanical switches that must be pushed by a user. Alternatively, the sensors 36 and 38 could comprise optical sensors, or the sensors 36 and 38 could comprise heart beat sensors.

Furthermore, the switches 36 and 38 (whatever type is used) could also function as lock and unlock switches in addition to providing information concerning the presence of a user's hand. For example, actuation of one or more of switches 38A-38C only (i.e. switches 36A-36B are not actuated) could be utilized by controller 8 as a lock signal, and actuation of only sensors 36A-36C (while none of the sensors 38A-38C are actuated) could be utilized by controller 8 as a unlock signal. However, simultaneous actuation of both sensors 36 and 38 could be utilized by controller 8 to signify the presence of a user's hand, and controller 8 may then unlatch powered latch 6 if unlatch switch 28 is actuated once within a predefined time interval and if controller 8 is in an unlocked state.

The handle and powered latch system of the present invention may also be configured to prevent inadvertent unlatching of powered latch 6 during emergency maneuvers. For example, with reference to table 1, if the vehicle is traveling at over 3 kph, and if the handle 12 is utilized in an interior front door configuration, controller 8 may be configured to require a full grasp (simultaneous actuation of at least one of sensors 36A-36C and sensors 38A-38C) and actuation of unlatch switch 28 twice within a predefined time interval (e.g. 3 seconds).

Also, the controller 8 may be configured to require that unlatch switch 28 is actuated twice within a predefined time interval (e.g. 3 seconds) if the RCM of the vehicle data system 50 detects a crash event as shown in table 2. Similarly, controller 8 may be configured to utilize lateral acceleration data from the vehicle data system 50 to determine that the vehicle is experiencing emergency maneuvers, and require that unlatch switch 28 be actuated twice within a predefined time interval during such emergency maneuvers.

The door handle 12 may also include a force detection feature as disclosed in co-pending U.S. patent application Ser. No. 14/282,224, filed on May 20, 2014, entitled "POWERED VEHICLE DOOR LATCH AND EXTERIOR HANDLE WITH SENSOR," now U.S. Pat. No. 9,834,964 the entire contents of which are incorporated herein by reference. If door handle 12 includes a force sensor, controller 8 may be configured to utilize the force data due to a user's pushing or pulling on handle 12 to control powered latch 6. For example, controller 8 could be configured such that an outward force on handle 12 could be construed as indicating a user's intent to open the vehicle door 1. However, a user might not push on handle 12 until after switch 28 has been actuated, and controller 8 could be configured to construe an outward force after actuation of switch 28 as indicating that the user is pushing on the handle 12 to brace himself or herself, rather than indicating an intent to open the vehicle door 1. This force check by controller 8 could be done before or while de-bouncing the switch as discussed in U.S. patent application Ser. No. 14/282,224.

Controller 8 may also be configured to utilize combinations of inputs from the various sensors to further identify intent to open vehicle door 1. For example, if the vehicle data system 50 determines that the vehicle is experiencing a sudden maneuver in a hard right hand turn, controller 8 could be configured to require actuation of unlatch switch 28 twice within a predefined time interval to unlatch the doors on the driver's side. However, the passenger side doors could require outboard force on handle 12 and a single actuation of unlatch switch 28 during a hard right turn to unlatch powered latch 6. However, in the event the vehicle data system 50 determines that the vehicle is experiencing a sudden maneuver in a hard left turn, controller 8 may be configured to unlatch the driver's side doors only if outboard force on handle 12 is detected and a single actuation of switch 28 occurs, whereas the passenger side doors could require actuation of the switch 28 twice within a predefined time period during hard left turns. In general, if vehicle data system 50 does not measure significant lateral acceleration, the vehicle speed is less than a predefined threshold (e.g. 3 kph), and a user is applying an outboard force on door handle 12, controller 8 could be configured to allow a single actuation of switch 28 to unlatch the powered latch 6.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An electronic control system for controlling vehicle access, comprising:

an electronic control system including a vehicle network operably interconnecting a programmable controller to a vehicle data system, the vehicle data system including at least one sensor configured to provide data concerning at least one vehicle operating parameter;

a plurality of electronically powered latch mechanisms that are configured to be actuated to shift from a latched configuration to an unlatched configuration upon receipt of a signal from the electronic control system; electrically conductive elements;

first and second capacitive electrodes, wherein the electrically conductive elements are electrically coupled to the electrodes and the electronic control system such that actuation of the first and second electrodes causes corresponding first and second signals to be transmitted to the electronic control system;

an unlatch switch that is operably connected to the programmable controller;

an unlock switch that is operably connected to the programmable controller; and wherein the programmable controller has an internal door lock status memory, and the programmable controller is configured to set the door lock memory state to the unlocked state if the programmable controller receives a signal from the unlock switch, and wherein the programmable controller is configured to determine that a user has grasped the interior handle if the first capacitive electrode detects that a user's hand is present at the same time as the second capacitive electrode also detects the presence of a hand, and wherein the programmable controller is configured to unlatch the powered latch mechanism when a signal from the unlatch switch is received if the door lock memory state is set to an unlocked state and the programmable controller has determined that a user's hand is present, and wherein the controller is configured such that the controller does not unlatch the powered latch mechanism when a signal from the unlatch switch is received after a predefined non-zero time interval of detecting the presence of a hand even if the presence of a hand is detected when the signal from the unlatch switch is received.

2. The electronic control system of claim 1, wherein:

the capacitive electrodes generate a first voltage if a user's hand is not present, and generate a second voltage if a user's hand is present, and wherein the programmable controller is configured to determine if a user's hand is present if a difference between the first and second voltages exceeds a predefined value.

3. The electronic control system of claim 2, wherein:

the programmable controller is configured to recalculate a baseline first voltage to compensate for changes in the first voltage due to changes in temperature.

4. The electronic control system of claim 1, wherein:

the programmable controller is configured to unlatch the powered latch mechanism only if the first and second capacitive electrodes detect the presence of a user's hand within a predefined time interval of actuation of the unlatch switch.

5. The electronic control system of claim 4, wherein:

the predefined time interval is three seconds.

6. An electronic control system for controlling vehicle access, comprising:

an electronic control system including a vehicle network operably interconnecting a programmable controller to a vehicle data system, the vehicle data system including at least one sensor configured to provide data concerning at least one vehicle operating parameter;

a plurality of electronically powered latch mechanisms that are configured to be actuated to shift from a latched configuration to an unlatched configuration upon receipt of a signal from the electronic control system;

electrically conductive elements;

first and second capacitive electrodes, wherein the electrically conductive elements are electrically coupled to the electrodes and the electronic control system such that actuation of the first and second electrodes causes corresponding first and second signals to be transmitted to the electronic control system;

an unlatch switch that is operably connected to the programmable controller;

an unlock switch that is operably connected to the programmable controller;

wherein the programmable controller has an internal door lock status memory, and the programmable controller is configured to set the door lock memory state to the unlocked state if the programmable controller receives a signal from the unlock switch, and wherein the programmable controller is configured to determine that a user has grasped the interior handle if the first capacitive electrode detects that a user's hand is present at the same time as the second capacitive electrode also detects the presence of a hand, and wherein the programmable controller is configured to unlatch the powered latch mechanism when a signal from the unlatch switch is received if the door lock memory state is set to an unlocked state and the programmable controller has determined that a user's hand is present, and wherein:

the programmable controller is configured to unlatch the powered latch when a vehicle speed is above a predefined vehicle speed only if the first and second capacitive sensors simultaneously detect the presence of a user's hand, and the unlatch switch is actuated twice within a predefined time interval.

7. An electronic control system for controlling vehicle access, comprising:

an electronic control system including a vehicle network operably interconnecting a programmable controller to a vehicle data system, the vehicle data system including at least one sensor configured to provide data concerning at least one vehicle operating parameter;

a plurality of electronically powered latch mechanisms that are configured to be actuated to shift from a latched configuration to an unlatched configuration upon receipt of a signal from the electronic control system;

electrically conductive elements;

first and second capacitive electrodes, wherein the electrically conductive elements are electrically coupled to the electrodes and the electronic control system such that actuation of the first and second electrodes causes corresponding first and second signals to be transmitted to the electronic control system;

an unlatch switch that is operably connected to the programmable controller;

an unlock switch that is operably connected to the programmable controller;

wherein the programmable controller has an internal door lock status memory, and the programmable controller is configured to set the door lock memory state to the unlocked state if the programmable controller receives a signal from the unlock switch, and wherein the programmable controller is configured to determine that a user has grasped the interior handle if the first capacitive electrode detects that a user's hand is present at the same time as the second capacitive electrode also detects the presence of a hand, and wherein the programmable controller is configured to unlatch the powered latch mechanism when a signal from the unlatch switch is received if the door lock memory state is set to an unlocked state and the programmable controller has determined that a user's hand is present, and wherein:

the programmable controller is configured to determine that a potential crash event has occurred if all of the capacitive electrodes simultaneously detect a user's hand, and wherein, if a potential crash event is detected, the programmable controller only unlatches the powered latch if the unlatch switch is actuated twice within a predefined time interval.

8. An electronic control system for controlling vehicle access, comprising:

an acceleration sensor configured to measure lateral acceleration of a vehicle;

an electronic control system including a vehicle network operably interconnecting a programmable controller to a vehicle data system, the vehicle data system including at least one sensor configured to provide data concerning at least one vehicle operating parameter;

a plurality of electronically powered latch mechanisms that are configured to be actuated to shift from a latched configuration to an unlatched configuration upon receipt of a signal from the electronic control system;

electrically conductive elements;

first and second capacitive electrodes, wherein the electrically conductive elements are electrically coupled to the electrodes and the electronic control system such that actuation of the first and second electrodes causes corresponding first and second signals to be transmitted to the electronic control system;

an unlatch switch that is operably connected to the programmable controller;

an unlock switch that is operably connected to the programmable controller;

wherein the programmable controller has an internal door lock status memory, and the programmable controller is configured to set the door lock memory state to the unlocked state if the programmable controller receives a signal from the unlock switch, and wherein the programmable controller is configured to determine that a user has grasped the interior handle if the first capacitive electrode detects that a user's hand is present at the same time as the second capacitive electrode also detects the presence of a hand, and wherein the programmable controller is configured to unlatch the powered latch mechanism when a signal from the unlatch switch is received if the door lock memory state is set to an unlocked state and the programmable controller has determined that a user's hand is present, and wherein:

the programmable controller does not unlatch the powered latch if the acceleration sensor detects lateral acceleration above a predefined magnitude unless the unlatch switch is actuated twice within a predefined time.

9. An electronic control system for vehicle access, comprising:

an interior handle including a force sensor that detects a force applied to the handle by a user;

an electronic control system including a vehicle network operably interconnecting a programmable controller to a vehicle data system, the vehicle data system including at least one sensor configured to provide data concerning at least one vehicle operating parameter;

a plurality of electronically powered latch mechanisms that are configured to be actuated to shift from a latched configuration to an unlatched configuration upon receipt of a signal from the electronic control system;

electrically conductive elements;

first and second capacitive electrodes, wherein the electrically conductive elements are electrically coupled to the electrodes and the electronic control system such that actuation of the first and second electrodes causes corresponding first and second signals to be transmitted to the electronic control system;

an unlatch switch that is operably connected to the programmable controller;

an unlock switch that is operably connected to the programmable controller;

wherein the programmable controller has an internal door lock status memory, and the programmable controller is configured to set the door lock memory state to the unlocked state if the programmable controller receives a signal from the unlock switch, and wherein the programmable controller is configured to determine that a user has grasped the interior handle if the first capacitive electrode detects that a user's hand is present at the same time as the second capacitive electrode also detects the presence of a hand, and wherein the programmable controller is configured to unlatch the powered latch mechanism when a signal from the unlatch switch is received if the door lock memory state is set to an unlocked state and the programmable controller has determined that a user's hand is present, and wherein:

the programmable controller does not unlatch the powered latch unless the first and second sensors detect the presence of a user's hand, the unlatch switch is actuated, and the force sensor detects a force exceeding a predefined magnitude.

10. The electronic control system of claim 1, wherein:

the programmable controller shifts from the unlocked state to the locked state if the second capacitive electrode detects the presence of a user's hand while the first capacitive electrode simultaneously does not detect the presence of a user's hand.

11. The electronic control system of claim 1, wherein:

the electrically conductive elements and first and second capacitive electrodes are disposed on first and second electronic circuit boards having curved outer surfaces facing in opposite directions.

12. A vehicle door, comprising;

a door structure;

an interior door handle having a manually actuated switch thereon and capacitive sensors disposed on opposite sides thereof;

a powered latch; and a controller configured to unlatch the powered latch if the capacitive sensors simultaneously detect a user's hand and the switch is actuated twice with a predefined time interval of the sensors detecting a user's hand while a vehicle speed is above a predefined vehicle speed.

13. The vehicle door of claim 12, wherein:

the interior door handle includes first and second opposite ends that are secured to the door structure and a central portion that is spaced apart from the door structure to define a gap that, in use, receives a portion of a user's hand.

14. The vehicle door of claim 12, wherein:

the manually actuated switch comprises a pushbutton switch that faces away from the door structure.

* * * * *